US008260185B2

(12) United States Patent
Matsubara et al.

(10) Patent No.: US 8,260,185 B2
(45) Date of Patent: Sep. 4, 2012

(54) LASER FIXING APPARATUS INCLUDING A CONDENSER FOR INCREASING LIGHT USAGE EFFICIENCY

(75) Inventors: Takashi Matsubara, Ashigarakami-gun (JP); Makoto Furuki, Ashigarakami-gun (JP); Naoyuki Egusa, Ashigarakami-gun (JP); Tetsuro Kodera, Ashigarakami-gun (JP); Miho Watanabe, Ashigarakami-gun (JP)

(73) Assignee: Fuji Xerox Co., Ltd., Tokyo (JP)

( * ) Notice: Subject to any disclaimer, the term of this patent is extended or adjusted under 35 U.S.C. 154(b) by 230 days.

(21) Appl. No.: 12/705,723

(22) Filed: Feb. 15, 2010

(65) Prior Publication Data

US 2011/0044741 A1 Feb. 24, 2011

(30) Foreign Application Priority Data

Aug. 20, 2009 (JP) ..... 2009-190914

(51) Int. Cl.
*G03G 15/20* (2006.01)

(52) U.S. Cl. ..... 399/336

(58) Field of Classification Search ..... 399/335, 399/336, 320, 122; 219/216
See application file for complete search history.

(56) References Cited

U.S. PATENT DOCUMENTS 4,435,069 A * 3/1984 Sato ..... 399/336
5,113,223 A * 5/1992 Theodoulou et al. ..... 219/220

FOREIGN PATENT DOCUMENTS

JP 55050282 A * 4/1980
JP 59095568 A * 6/1984
JP 59128569 A * 7/1984
JP 3016685 B2 12/1999
JP 2007-057903 A 3/2007

* cited by examiner

*Primary Examiner* — Walter L Lindsay, Jr.
*Assistant Examiner* — Billy J Lactaoen
(74) *Attorney, Agent, or Firm* — Sughrue Mion, PLLC

(57) ABSTRACT

A laser fixing apparatus includes a laser light generator that generates laser light to be projected onto a recording medium; and a first condenser that reflects and condenses light reflected at an irradiation position of the laser light, such that the reflected light reenters at the irradiation position or near the irradiation position. The first condenser has a concave cylindrical surface and is arranged such that a center axis position of the cylindrical surface is located at the irradiation position of the laser light or near the irradiation position, and a reflecting surface of the first condenser is covered by a light transmitting body.

10 Claims, 11 Drawing Sheets

LASER FIXING APPARATUS INCLUDING A CONDENSER FOR INCREASING LIGHT USAGE EFFICIENCY

CROSS-REFERENCE TO RELATED APPLICATION

This application is based on and claims priority under 35 USC 119 from Japanese Patent Application No. 2009-190914 filed on Aug. 20, 2009.

BACKGROUND

1. Technical Field

The present invention relates to a laser fixing apparatus and an image forming apparatus.

2. Related Art

In image forming apparatuses employing powdered toner, such a type is widely used that a toner image formed by adhesion of toner is transferred from an image carrier onto a recording medium and then the toner image is fixed to the recording medium. Then, known methods of fixing a toner image include a contact type and a non-contact type.

In the contact type, for example, an endless heating member whose peripheral surface is to be heated and a pressurizing member in contact with the heating member are provided. Then, in a state that a recording medium is pinched between these members, a toner image is heated and pressurized so that the toner image is fixed to the recording medium.

On the other hand, in comparison with the apparatuses of contact type described above, fixing apparatuses of non-contact type do not contact with recording media and hence have an advantage in the universality of recording media and in achieving high speeds. In such fixing apparatuses of non-contact type, a flash lamp arranged opposite to a transporting path for a recording medium is intermittently turned ON so that a toner image on the recording medium under transport is heated and fixed.

SUMMARY

According to an aspect of the invention, a laser fixing apparatus comprises: a laser light generator that generates laser light to be projected onto a recording medium; and a first condenser that reflects and condenses light reflected at an irradiation position of the laser light, such that the reflected light reenters at the irradiation position or near the irradiation position, wherein the first condenser has a concave cylindrical surface and is arranged such that a center axis position of the cylindrical surface is located at the irradiation position of the laser light or near the irradiation position, and a reflecting surface of the first condenser is covered by a light transmitting body.

BRIEF DESCRIPTION OF THE DRAWINGS

Exemplary embodiments of the invention will be described in detail based on the following figures, wherein.

DETAILED DESCRIPTION

Figure 1:
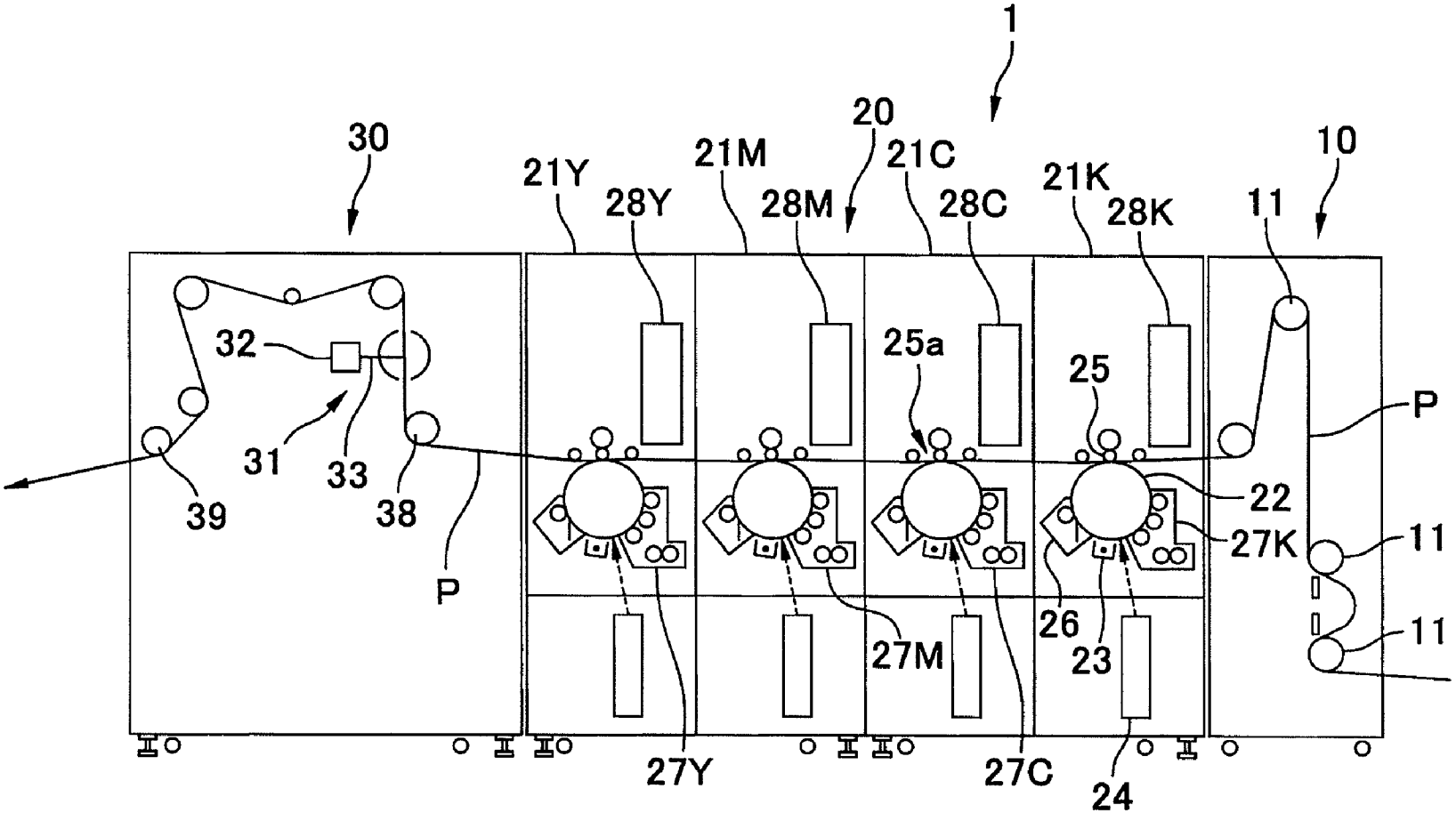
FIG. 1 is a schematic configuration diagram of an image forming apparatus according to an exemplary embodiment of the present invention.

FIG. 1 is a schematic configuration diagram of an image forming apparatus according to an exemplary embodiment of the present invention.

This image forming apparatus 1 is a large-size apparatus for forming an image on continuous paper (continuous printing paper also known as continuous form sheets; referred to as "continuous paper", hereinafter) serving as a recording medium and is constructed from: a paper transporting section 10 for transporting and supplying continuous paper P; an image forming section 20 for forming and transferring an image onto the continuous paper P; and a fixing section 30 for fixing the transferred image.

The paper transporting section 10 has plural of wound-around rollers 11 around each of which the continuous paper P is wound and transported. Thus, the continuous paper P is transported to the image forming section 20 in a state that a tension is imparted.

In the image forming section 20, four image forming units 21K, 21C, 21M, and 21Y for transferring toner (image forming material) of black (K), cyan (C), magenta (M), and yellow (Y), respectively in this order from the upstream so as to form a toner image serving as a visible image are arranged at almost equal intervals along the direction of transport of the continuous paper.

Each of the image forming units 21K, 21C, 21M, and 21Y has a photosensitive material drum 22 in which a photoconductivity layer is formed on the outer peripheral surface of a cylindrical member composed of conductive material. Then, around the photosensitive material drum 22, arranged are: an electrostatic charging unit 23 for electrostatically charging uniformly the surface of the photosensitive material drum 22; an exposure device 24 for projecting image light onto the electrostatically charged photosensitive material drum 22 so as to form a latent image on the surface; a developing unit 27 for transferring toner to the latent image on the photosensitive material drum 22 so as to form a toner image; a transfer roller 25 arranged opposite to the photosensitive material drum 22 and transferring onto continuous paper the toner image formed on the photosensitive material drum; and a cleaning device 26 for removing toner remaining on the photosensitive material drum 22 after the toner image is transferred.

Here, in each of the four image forming units 21K, 21C, 21M, and 21Y, the color of the toner accommodated in the developing unit 27 is different from those of others. The other points in the configuration are the same. Then, above the developing units 27K, 27C, 27M, and 27Y, toner supply containers 28K, 28C, 28M, and 28Y each accommodating toner of a color corresponding to that of the toner in each developing unit are arranged so that toner consumed in association with development is supplied to each developing unit.

The fixing section 30 provided downstream the image forming section 20 has: a laser fixing apparatus 31 for fixing the not-yet-fixed toner image transferred onto the continuous paper by the image forming section 20; a transport roller 38 around which the continuous paper P onto which a toner image has been transferred is wound and which guides the continuous paper to the laser fixing apparatus 31; and a paper ejection roller 39 for ejecting to the outside of the apparatus the continuous paper P to which the toner image has been fixed.

In this image forming apparatus, when image formation operation is started, the photosensitive material drum 22 is electrostatically charged almost uniformly into a negative polarity by the electrostatic charging unit 23. Then, on the basis of image data, the exposure device 24 projects image light onto the peripheral surface of the electrostatically charged photosensitive material drum 22, so that on the surface of the photosensitive material drum 22, a latent image is formed on the basis of a potential difference between an exposure part and a non-exposure part. In the developing unit 27, a thin layer of developing powder is formed on the peripheral surface of the development roller. Then, in association with the revolution of the development roller, the developing powder in the form of a thin layer is transported to the development position opposite to the peripheral surface of the photosensitive material drum 22. At the development position, an electric field is formed between the photosensitive material drum 22 and the development roller. Thus, within this electric field, the toner on the development roller is transferred to the latent image on the photosensitive material drum, so that a toner image is formed. Then, in association with the revolution of the photosensitive material drum 22, the toner image formed as described here is transported to the transfer and pressurization section 25*a* where the transfer roller 25 is pressed against.

On the other hand, the continuous paper P transported from the paper transport section 10 is fed into the transfer and pressurization section 25*a*. In the transfer and pressurization section 25*a*, an electric field is formed by a transfer bias voltage. Then, within this electric field, the toner image is transferred to the continuous paper P. The continuous paper P is transported sequentially to the transfer and pressurization section 25*a* of each image forming unit 21, so that toner images of individual colors are transferred and stacked.

The continuous paper P onto which a toner image has been transferred is transported around the transport roller 38 and sent to the laser fixing apparatus 31 in a state that the toner image is held. In the laser fixing apparatus 31, laser light 33 is projected onto the continuous paper P so as to heat and fix the toner. The continuous paper P on which the toner image has been fixed is ejected to the outside of the apparatus by the paper ejection roller 39.

Next, the laser fixing apparatus 31 employed in the image forming apparatus is described below.

Figure 2:
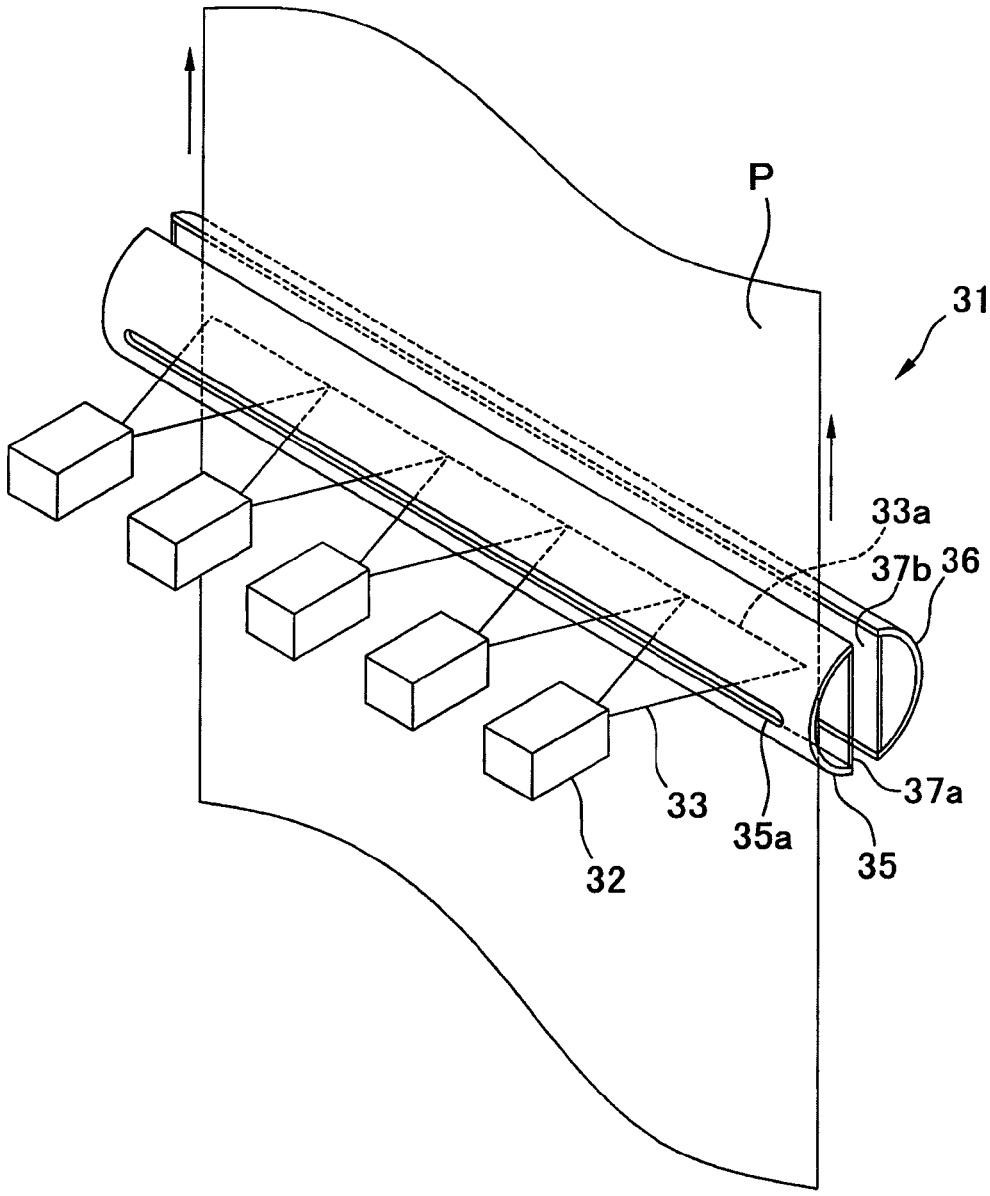
FIG. 2 is a schematic perspective view of a laser fixing apparatus according to an exemplary embodiment of the present invention, which is employed in an image forming apparatus shown in FIG. 1.
Figure 3:
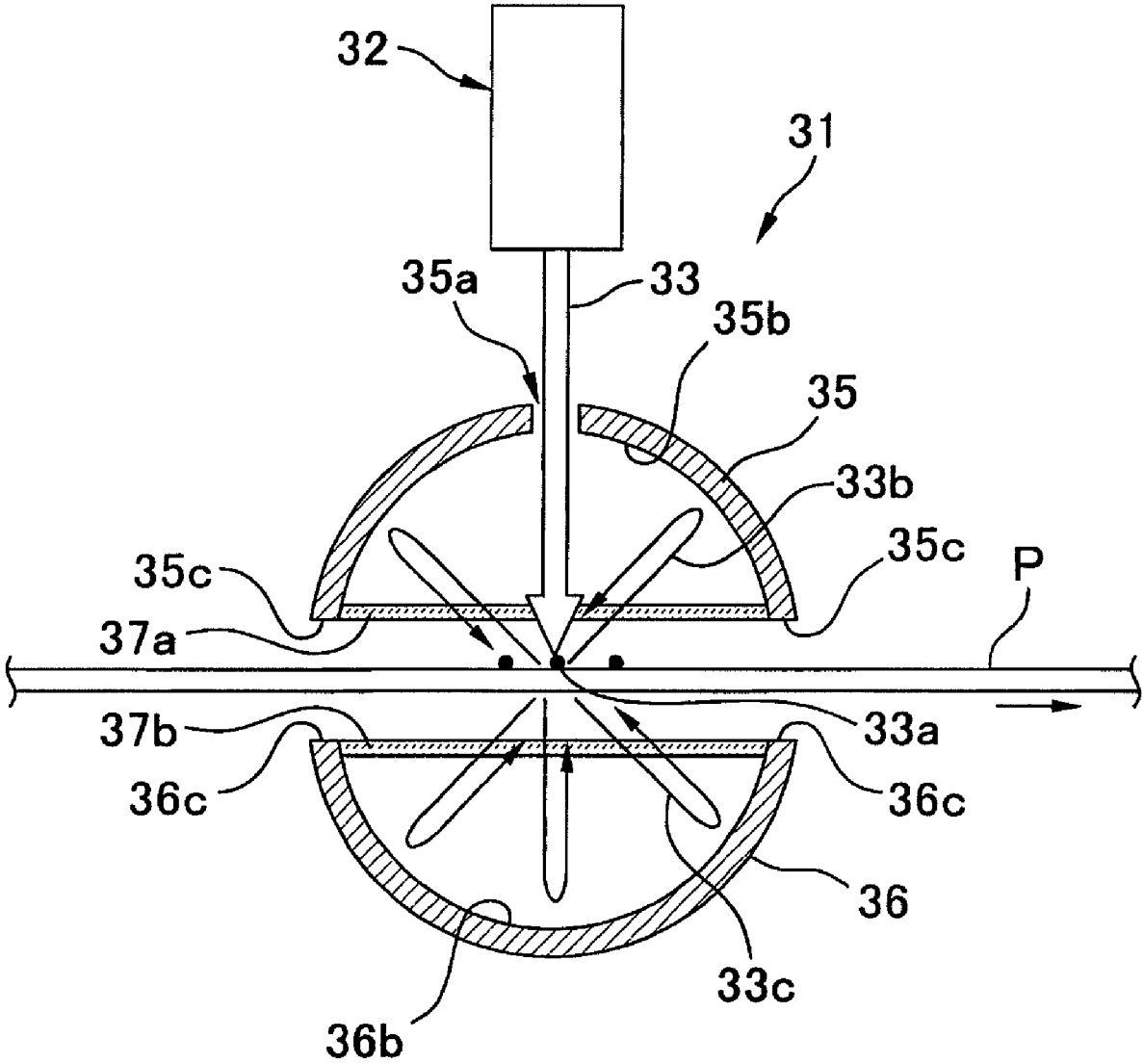
FIG. 3 is a schematic sectional view of a laser fixing apparatus shown in FIG. 2.

FIG. 2 is a schematic perspective view of a laser fixing apparatus 31 according to an exemplary embodiment of the present invention. FIG. 3 is a schematic sectional view.

The principal part of this laser fixing apparatus 31 is constructed from: a laser light generator 32 for projecting laser light 33 over the entire width of the region where the image is transferred in the continuous paper P that is moving; a condenser 35 for causing scattered light 33*b* generated by the laser light 33 reflected by the continuous paper P to be projected again onto the continuous paper P; a rear side condenser 36 for reflecting light 33*c* transmitted and scattered by the continuous paper P and thereby condensing the light 33*c* from the rear side of the continuous paper P into the irradiation position; and glass plates 37*a* and 37*b* each composed of a light transmitting body for covering each of the reflecting surfaces 35*b* and 36*b* of the condenser 35 and the rear side condenser 36.

Plural of the laser light generators 32 are arranged in the width direction of the continuous paper P (a direction perpendicular to the transport direction). Then, the laser light 33 emitted from the laser light generators 32 is projected onto the continuous paper P within a region set up in advance in the direction of moving of the continuous paper P. Further, plural of laser light generators 32 are arranged in the width direction of the continuous paper P that is moving, such that the irradiation energy is distributed almost uniformly over the entire width of the region where the image is transferred. Then, the irradiation energy is adjusted such that the toner passing through the irradiation region of the laser light 33 is heated and fixed onto the continuous paper P.

Here, in the present exemplary embodiment, semiconductor laser devices are employed so that irradiation is achieved with a beam width of approximately 1 mm in the direction of transport of the continuous paper P.

The condenser 35 is composed of a metal mirror whose reflecting surface 35*b* has the shape of a concave cylindrical surface, and is arranged such that the reflecting surface 35*b* is opposite to the continuous paper P. Then, the condenser 35 is supported such that the center axis of the cylindrical surface is almost perpendicular to the direction of transport of the continuous paper P. In the center part in the circumferential direction of the reflecting surface 35*b* having the shape of a cylindrical surface, a slit 35*a* (an example of an entrance opening) formed in the shape of an opening elongated in the axial direction is provided. Thus, the laser light 33 emitted toward the continuous paper P passes through the slit 35*a*, and is then transmitted through the glass plate 37*a* and then projected onto the continuous paper P. Here, the light source is located in the outside of the condenser (on the side reverse to the reflecting surface), and hence a possibility is avoided that the light source generates a shadow in the reflecting surface. Thus, this configuration is preferable.

The reflecting surface 35*b* of the condenser 35 covers the position where the laser light 33 is first projected onto the continuous paper P, that is, the primary irradiation position 33*a*. Further, in the width direction of the continuous paper P, the entire width of the region where the image is formed is covered. Then, the center axis position of the cylindrical surface of the condenser is set up at the primary irradiation position 33*a* where the laser light is projected onto the continuous paper P, or alternatively near the primary irradiation position. As a result, the condenser 35 repeatedly reflects and condenses a major part of the scattered light 33*b* reflected by the continuous paper, at the primary irradiation position 33*a* or near this position.

Here, the center axis position of the reflecting surface 35*b* having the shape of a cylindrical surface may deviate somewhat in the direction of moving of the continuous paper P or alternatively in a direction perpendicular to the surface of the continuous paper, as long as the scattered light reflected at the primary irradiation position can be condensed near the primary irradiation position.

The description "to condense at the primary irradiation position or near the primary irradiation position" indicates that in comparison with the irradiation energy of the laser light projected primarily, condensation is achieved to an extent that the fixing effect on toner particles, especially, on isolated toner particles, at the primary irradiation position is increased by the additional energy of the light reflected and condensed by the condenser. Thus, in addition to a case that the light condensed by the condenser is projected accurately at the primary irradiation position, the light may be projected at the primary irradiation position and near the position. Further, in the distribution of the irradiation energy of the light condensed by the condenser, the peak position may somewhat deviate from the primary irradiation position.

In the present exemplary embodiment, the radius of the cylindrical surface of the condenser 35 is 50 mm. The gap between each edge 35*c* in the circumferential direction and the continuous paper under transport is 5 mm.

The rear side condenser 36 is composed also of a metal mirror whose reflecting surface 36*b* has the shape of a concave cylindrical surface. On the rear side of the continuous paper P under transport, the condenser 35 is arranged such that the center axis of the cylindrical surface is almost perpendicular to the direction of transport of the continuous paper P. Then, scattered light 33*c* having been transmitted through the continuous paper P at the primary irradiation position 33*a* is reflected toward the rear side of the continuous paper P.

Similarly to the condenser 35, the rear side condenser 36 is formed such as to cover the rear side of the primary irradiation position 33*a* of the continuous paper P and, in the width direction of the continuous paper P, cover the entire width of the region where the image is formed. Further, the center axis position of the cylindrical surface serving as the reflecting surface 36*b* is set up at the primary irradiation position 33*a* where the laser light is projected onto the continuous paper P, or alternatively near the primary irradiation position. As a result, the rear side condenser 36 condenses a major part of the light 33*c* generated by scattering of the laser light transmitted through the continuous paper, at the primary irradiation position 33*a* or near this position on the rear side of the continuous paper.

The glass plates 37*a* and 37*b* are provided such as to cover each of the reflecting surfaces 35*b* and 36*b* of the condenser 35 and the rear side condenser 36. As shown in FIG. 3, the glass plates 37*a* and 37*b* are formed in a plate shape and supported at the two edges 35*c* and 36*c* of the condenser 35 or the rear side condenser 36 in the circumferential directions. Thus, the laser light 33 is transmitted through the glass plate 37*a* and then projected onto the continuous paper P. Then, scattered light 33*b* reflected at the primary irradiation position 33*a* is transmitted through the glass plate 37*a* and then reaches the reflecting surface 35*b* so as to be condensed at the primary irradiation position 33*a*.

Since the glass plates 37*a* and 37*b* are provided such as to cover the condenser 35 and the rear side condenser 36, dirt on the reflecting surfaces of the condensers is avoided. When toner is heated by projection of the laser light 33, components like resin contained in the toner float in the space between the continuous paper P and the condenser 35 or the space between the continuous paper P and the rear side condenser 36. However, since the reflecting surfaces 35*b* and 36*b* of the condenser 35 and the rear side condenser 36 are covered by the glass plates 37*a* and 37*b*, adhesion of dirt is avoided. Cleaning of the reflecting surfaces of the condensers is difficult. Further, in particular, in a case that the condensers are composed of metal mirrors, if components like toner adhere, their removal by cleaning is difficult. However, in the present exemplary embodiment, since reflecting surfaces are covered by glass plates as described above, cleaning is easy and hence dirt having adhered to the glass plates is removed easily.

Next, the operation of the laser light 33 performed on the continuous paper P onto which a toner image has been transferred is described below.

A toner image transferred on the continuous paper P has high density parts and low density parts in a mixed form. In high density parts, toner particles adhere to the continuous paper P in a closely packed manner. In contrast, in low density parts, toner particles adhere to the continuous paper in a dispersed manner. The dispersed toner particles adhering in low density parts include: a group of plural of toner particles mutually aggregated; and a single toner particle adhering in an isolated manner (referred to as an "isolated toner particle", hereinafter). Further, in case of occurrence of fogging (a phenomenon that during the development operation, toner adheres to a non-image region where the toner should intrinsically not adhere), a large number of isolated toner particles are generated.

Figure 4A:
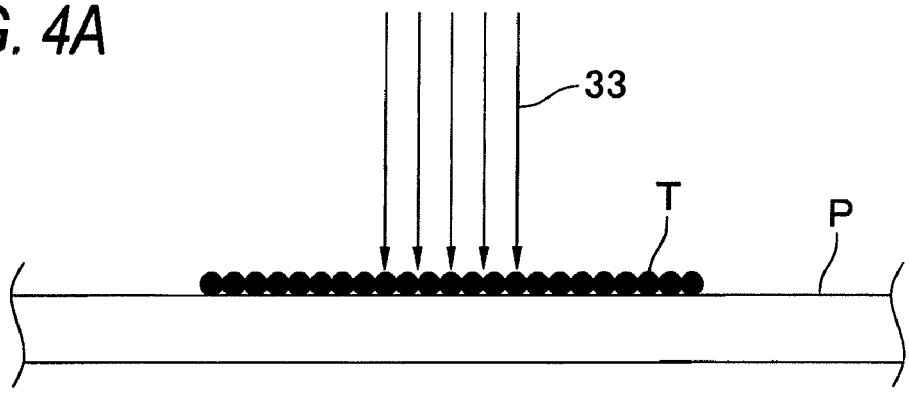
FIG. 4 is a schematic diagram showing a state that laser light is projected onto continuous paper onto which a toner image has been transferred.

As shown in FIG. 4A, in a high density part, a major part of laser light 33 projected from the laser light generator 32 is projected onto toner particles T, and hence reflected and scattered light is generated merely at a low intensity. Then, the output of the irradiation energy of the laser light generator 32 is adjusted such that in this state, the toner particles T absorb the irradiation energy of the laser light 33 so as to be heated to a temperature suitable for fixing.

Figure 4B:
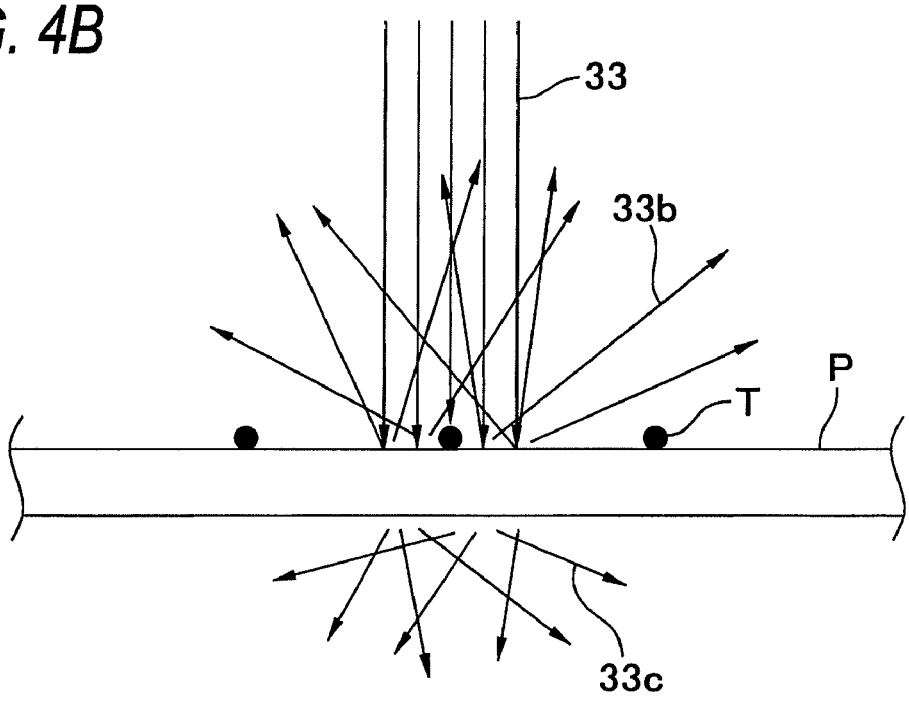

In contrast, in low density parts, adhering toner has a low closeness of packing. Thus, as shown in FIG. 4B, when laser light 33 is projected onto toner particles T at the primary irradiation position of the laser light 33, the laser light 33 is projected simultaneously onto the periphery of the toner particles T and then reflected so as to generate scattered light 33*b*. Further, a part of the light is transmitted through the continuous paper P and generates scattered light 33*c* on the rear side. At that time, the irradiation energy of the laser light 33 projected directly onto the toner particles T has no substantial difference from that of toner particles in high density parts. Nevertheless, in contrast to toner particles in high density parts which are formed in a closely packed manner, toner particles in low density parts have larger surface areas of contact with outside air, and hence have higher heat radiation rates and are heated insufficiently in some cases. Thus, poor fixing occurs frequently. In particular, in isolated toner particles adhering in an isolated manner on an individual particle basis, poor fixing caused by insufficient heating occurs frequently.

As such, toner particles in low density parts and isolated toner particles have a possibility that the toner particle is not sufficiently heated by the irradiation energy of the laser light, and hence stays in a not-fixed state. Toner particles in a not-fixed state can adhere to the paper ejection roller 39 and the like so as to cause dirt in the printing paper or in the inside of the apparatus.

On the other hand, with taking into consideration the loss of irradiation energy in low density parts, if the output of the laser light are set up higher, toner particles in high density parts would be heated excessively. This could cause image defects in high density parts or alternatively an increase in scattering of toner resin.

With taking such situations into consideration, in the laser fixing apparatus according to the present exemplary embodiment, the irradiation energy of the laser light 33 is adjusted such that high density parts are fixed appropriately. Further, the condenser 35 and the rear side condenser 36 are arranged on the front side and the rear side of the continuous paper P under transport. As a result, in high density parts, fixing is achieved appropriately. Further, in low density parts, scattered light 33*b* generated by laser light 33 projected onto and reflected by the continuous paper P at the primary irradiation position 33*a* or alternatively light 33*c* transmitted and scattered on the rear side of the continuous paper P is condensed at the primary irradiation position 33*a* of the laser light 33 or near the primary irradiation position, so that irradiation energy is increased for toner particles in low density parts or for isolated toner particles.

That is, in a region where low density parts or isolated toner particles are present, reflected light 33*b* and transmitted light 33*c* are generated at higher intensities. Thus, such light components are condensed at the primary irradiation position 33*a* or near the primary irradiation position so as to be projected onto the toner particles T. At that time, the light projected onto the continuous paper near the toner particles generates scattered light, which is condensed by the condenser 35 or the rear side condenser 36 and then projected repeatedly onto the toner particles. This causes an increase in the irradiation energy projected onto the toner particles, so that even toner in low density parts and isolated toner particles are fixed satisfactorily.

In contrast, high density parts have high absorption coefficients for the laser light 33. Thus, reflected light 33*b* and transmitted light 33*c* are generated merely at low intensities at the primary irradiation position 33*a*. Accordingly, the intensity of light reflected by the condenser 35 or by the rear side condenser 36 and then returned to the primary irradiation position 33*a* is low. Thus, merely a low possibility is present that high density parts are heated excessively.

In general, in an image formed by adhesion of toner, high density parts and low density parts are mixed. Then, in the laser fixing apparatus 31, the region where the laser light is projected is as narrow as approximately 1 mm in the direction of moving of the continuous paper P. Then, when the region where the laser light is projected has a high density, reflected light is generated merely at a low intensity and hence the energy of re-irradiation is also low. In contrast, when the region where the laser light is projected has a low density, an increased intensity of scattered light reflected by the continuous paper P and an increased intensity of scattered light transmitted through the continuous paper P are generated. This causes an increase in the energy of re-irradiation at the primary irradiation position. Thus, satisfactory fixing is achieved both in high density parts and in low density parts.

In the above-mentioned exemplary embodiment, the beam width of the laser light has been approximately 1 mm. However, this beam width may be changed.

Next, description is given for the difference between the condenser 35 in the above-mentioned exemplary embodiment and a mirror in a fixing apparatus employing a related art flash lamp.

Figure 13A:
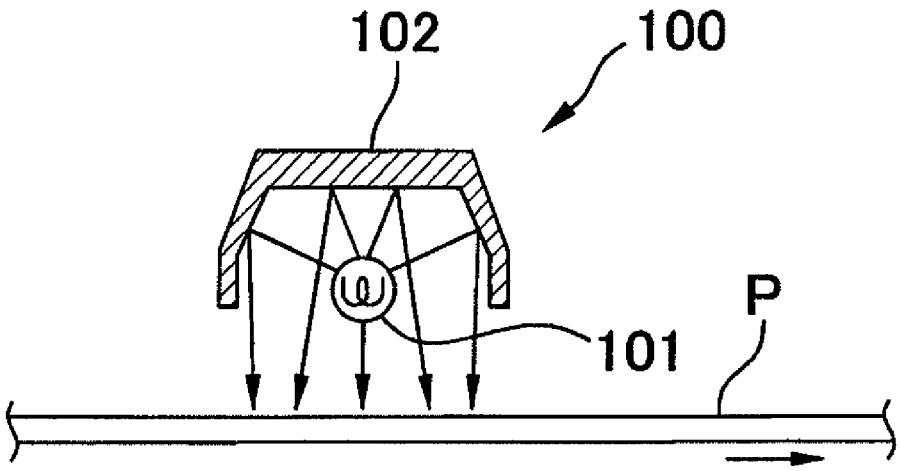
FIG. 13 is a schematic sectional view showing a related art flash lamp fixing apparatus.
Figure 13B:
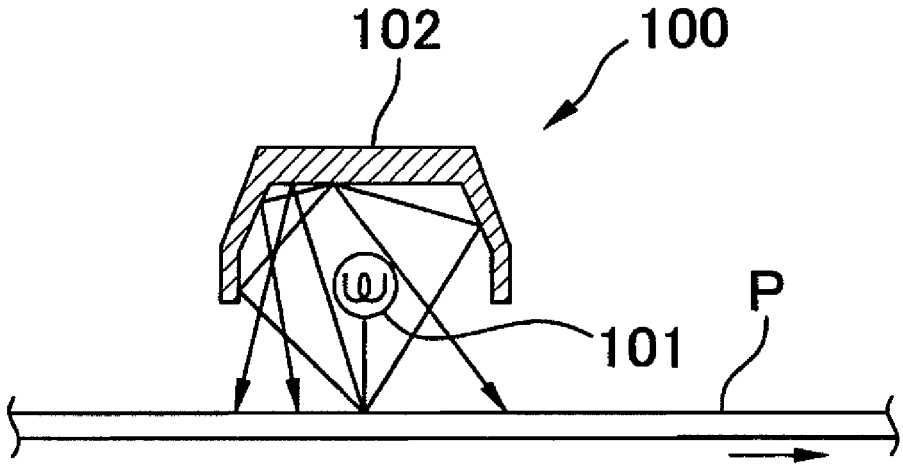

As shown in FIG. 13, in a fixing apparatus 100 employing a related art flash lamp, a flash lamp 101 is arranged in the width direction of the recording medium P under transport. Then, a mirror 102 serving as a reflector is provided such as to cover the rear face and the side faces of the flash lamp 101. As shown in FIG. 13A, the mirror 102 reflects the light of the flash lamp 101 emitted in all directions, especially the light emitted rearward and sideward, such that the light is projected onto the recording medium P uniformly in the entirety. At that time, the light reflected by the mirror 102 is distributed and projected over a large region of the recording medium P opposite to the flash lamp 101. Further, as shown in FIG. 13B, the mirror 102 has also the function of reflecting again the light projected onto and reflected by the recording medium and thereby projecting the light onto the recording medium. Nevertheless, the mirror 102 reflects intact in a dispersed manner the light having diverse incident angles, and does not condense the light into a particular region. Thus, irradiation energy is supplied approximately uniformly over the region of the recording medium P opposite to the flash lamp 101. Accordingly, even when high density parts and low density parts are mixed in the recording medium P, irradiation energy is supplied approximately uniformly regardless of the image density.

In contrast, in the laser fixing apparatus 31 according to the present exemplary embodiment, the laser light 33 is projected onto a limited region at the primary irradiation position 33*a*. Then, the light reflected by the recording medium is condensed and projected at the primary irradiation position. In particular, when the image density at the primary irradiation position is low, a high intensity of light is reflected by the recording medium. As such, the condenser 35 and the rear side condenser 36 are installed for a purpose different from that of the mirror in the fixing apparatus employing a flash lamp, and have a completely different function.

Next, a laser fixing apparatus according to a second exemplary embodiment of the present invention is described below with reference to FIG. 5.

Similarly to that in the first exemplary embodiment, the laser fixing apparatus 41 has: a laser light generator 42 for projecting laser light 43 onto continuous paper P that is moving; and a condenser 45 for re-projecting, onto the continuous paper P, scattered light 43*b* generated by the laser light 43 reflected by the continuous paper P. Then, the light transmitting body covering the reflecting surface 45*a* of the condenser 45 is composed of a cylindrical surface glass sheet 46 constructed from a thin glass sheet formed into a cylindrical surface shape.

Here, the laser light generator 42 and the condenser 45 are similar to those in the first exemplary embodiment, and hence their description is omitted.

The cylindrical surface glass sheet 46 has an almost uniform thickness in the circumferential direction, and is arranged closely along with the curved surface of the reflecting surface 45*b* of the condenser 45. The center axis of the cylindrical surface glass sheet 46 is almost agrees with that of the condenser 45. Then, laser light 43 enters through the slit 45*a* of the condenser 45, and is then transmitted through the cylindrical surface glass sheet 46 and then projected onto the continuous paper P. Thus, the laser light is projected on the continuous paper at the primary irradiation position 43*a*, and then the reflected scattered light enters the cylindrical surface glass sheet 46 almost perpendicularly.

When the scattered light 43*b* enters the cylindrical surface glass sheet 46 and is then transmitted, a part of the incident light is reflected by the interface between air and the glass and by the interface between the glass and air. However, as described above, the scattered light 43*b* enters the cylindrical surface glass sheet 46 almost at right angles. This reduces the reflectivities in the interfaces, and hence reduces dissipation of the irradiation energy reflected and dissipated in the interfaces.

The reason why the dissipated energy is reduced as mentioned above is described below.

Figure 7A:
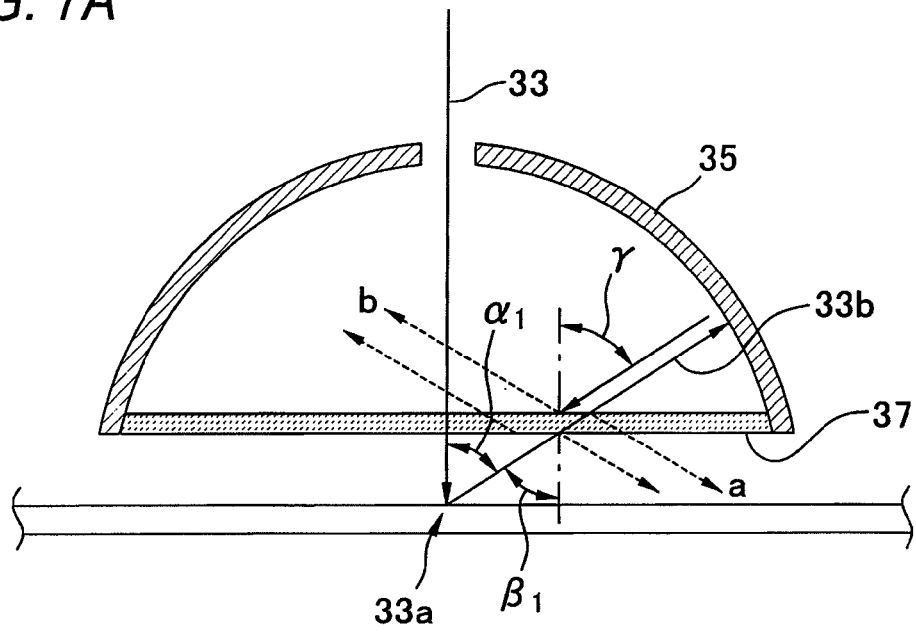
FIG. 7 is a schematic diagram showing the incident angle of scattered light into a light transmitting body in a laser fixing apparatus shown in FIGS. 3 and 5.

As shown in FIG. 3, in a case that the flat glass plate 37 is employed as a light transmitting body covering the reflecting surface of the condenser, scattered light 33*b* projected onto and reflected by the continuous paper P is dissipated as follows. That is, as shown in FIG. 7A, the light incident on the glass plate 37 is transmitted through the glass plate, but a part of the light is reflected by the interface between air and the glass. Further, also in the interface from the inside of the glass plate to air, a part of the light is reflected similarly. Further, the reflected light that has transmitted through the glass plate 37 and reached the condenser 35 and that is then reflected and returns to the primary irradiation position 33*a* passes again through the glass plate 37. At this time, a part of the light is reflected similarly. The light reflected by the glass plate 37 as described here is dissipated as indicated by symbols a and b in FIG. 7A, and hence hardly contributes to heating of the toner on the continuous paper. In particular, among the scattered light generated at the primary irradiation position 33*a*, each component having a large scattering angle $\alpha_1$ has also a large incident angle $\beta_1$ onto the glass plate 37. Further, when the transmitted light is reflected by the condenser 35 and then re-enters the glass plate 37, the light has a large incident angle $\gamma$. A larger incident angle onto the glass plate 37 causes a higher reflectivity in the interface between the glass and air, and hence a higher dissipation in the energy of the light.

Figure 6:
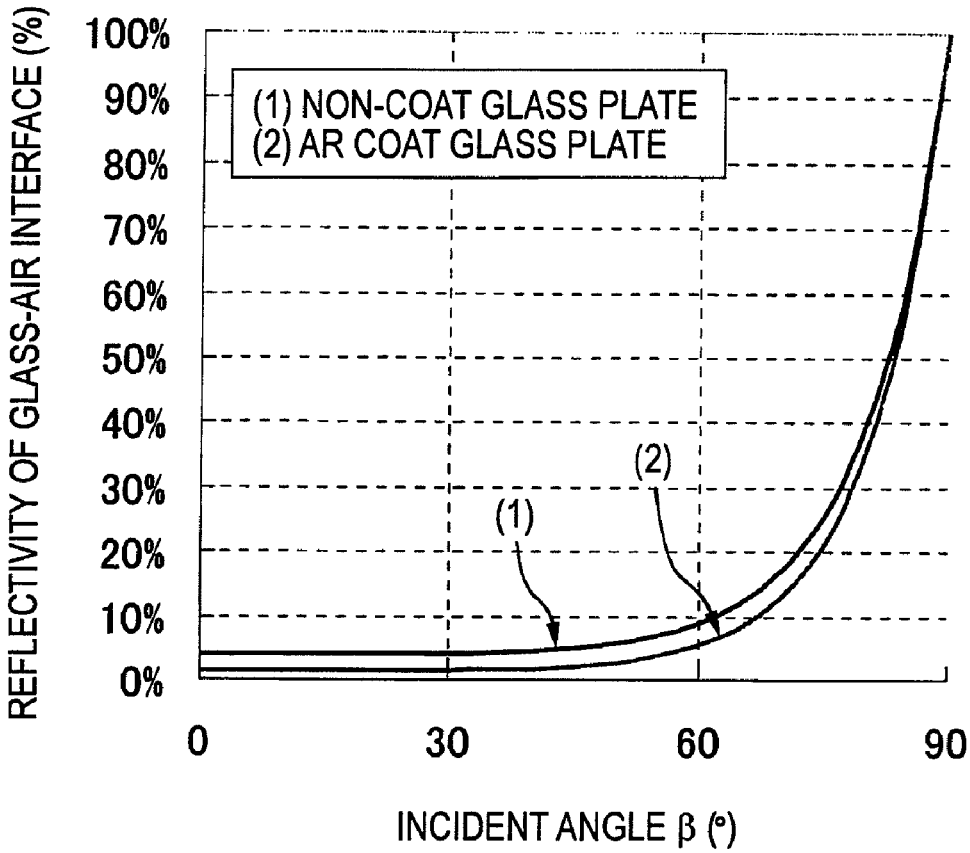
FIG. 6 is a diagram showing the relation between the incident angle and the reflectivity of scattered light.

FIG. 6 is a diagram showing the relation between the incident angle and the reflectivity of light in the interface between the glass and air.

The reflectivity in the interface between the glass and air is approximately 4% at an incident angle of 0 degree, that is, in a case that the light is incident on the interface at right angles. Then, when the incident angle increases to 30 degrees or larger, the reflectivity increases gradually. When the incident angle exceeds 60 degrees, the reflectivity increases steeply. Application of an antireflection film (AR coat) or the like onto the surface of the glass has the effect of reducing the reflectivity at small incident angles. Nevertheless, even in this case, the reflectivity increases steeply at large incident angles, which is the same as the case of no antireflection film.

Figure 7B:
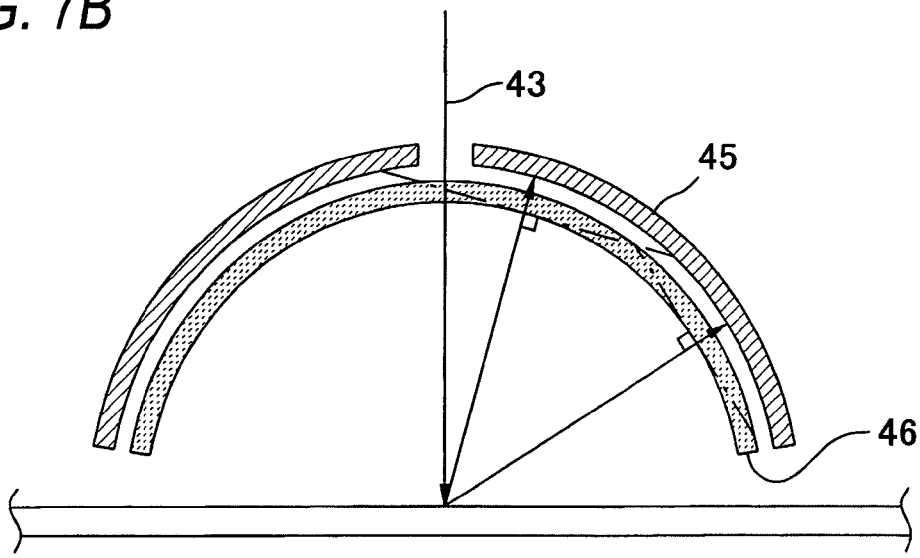

In such a part having a large scattering angle $\alpha_1$ of the light generated by scattering of the projected laser light 33 at the primary irradiation position 33*a*, an increase is caused in the energy reflected and dissipated by the glass plate 37. In contrast, as shown in FIG. 7B, in a case that the cylindrical surface glass sheet 46 is employed as a light transmitting body covering the reflecting surface of the condenser 45, almost the entirety of the scattered light going toward the reflecting surface of the condenser 45 enters the cylindrical surface glass sheet 46 approximately at right angles. This reduces the reflectivity in the cylindrical surface glass sheet 46, and hence causes an increase in the energy reflected by the condenser 45 and then re-projected at the primary irradiation position. Further, even the light reflected by the cylindrical surface glass sheet 46 reenters at the primary irradiation position. This reduces the dissipated energy.

Next, the utilization efficiency of the irradiation energy of laser light is described below in a case that the reflecting surface is covered by the flat glass plate 37 or the cylindrical surface glass sheet 46.

Figure 8:
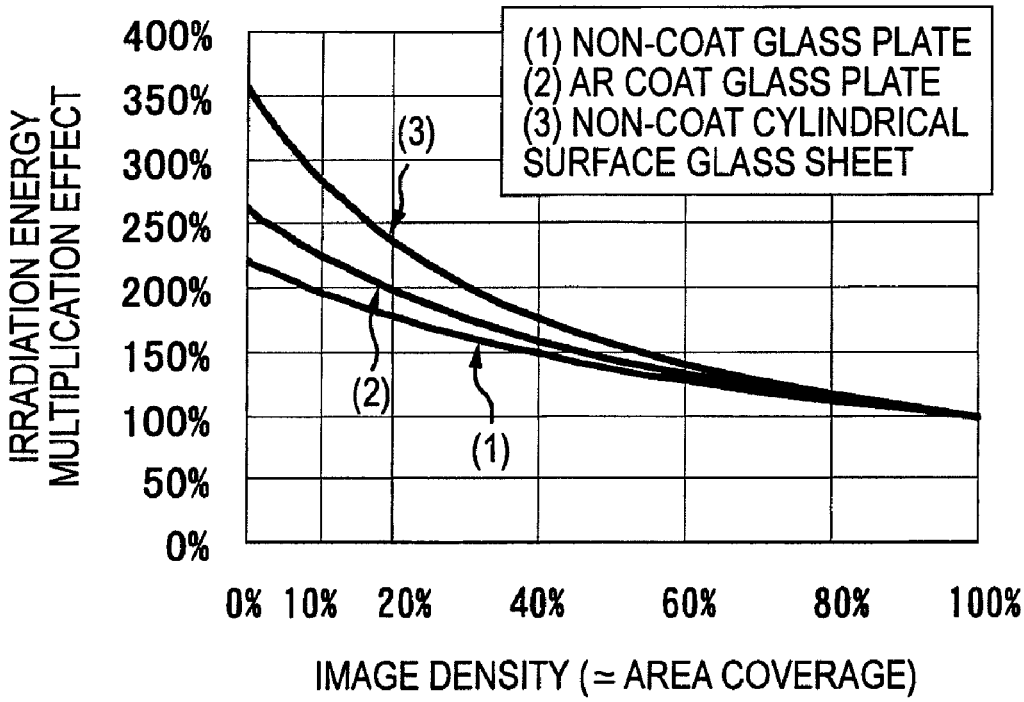
FIG. 8 is a diagram showing the reuse efficiency of irradiation energy of laser light in a laser fixing apparatus shown in FIGS. 3 and 5.

FIG. 8 is a diagram showing the result of calculations of the reuse efficiency of laser light obtained by simulations for laser light projected at the primary irradiation position in a case that that the reflecting surface of the condenser is covered by the flat glass plate 37 or the cylindrical surface glass sheet 46.

These calculations are carried out for various image density values in a case that a non-coat glass plate or an AR coat glass plate is employed as the flat glass plate and in a case that a cylindrical surface glass sheet of non-coat is employed. Here, the AR coat glass plate is fabricated by covering the two surfaces of a glass plate with $MgF_2$ of a thickness of 147 nm. The wavelength of laser light is 810 nm.

As shown in FIG. 8, in a high density part whose image density (area coverage) is 100%, no substantial variation in the irradiation energy on the toner particles is found in the non-coat glass plate, the AR coat glass plate, and the cylindrical surface glass sheet. Further, no substantial increase in the irradiation energy is obtained, which could be expected by condensation of light at the primary irradiation position by the condenser.

On the other hand, in a low density part whose image density is 10%, laser light is projected onto toner particles at the primary irradiation position, and at the same time, light projected onto and reflected by the continuous paper is reflected by the condenser and then projected onto the toner particles. Thus, the energy projected onto the toner particles increases to approximately 200% in the non-coat glass plate, approximately 225% in the AR coat glass plate, and approximately 280% in the cylindrical surface glass sheet. This indicates that when the cylindrical surface glass sheet 46 is employed, a high utilization efficiency is obtained in the light reflected and scattered at the primary irradiation position, and hence an increase is obtained in the energy projected onto the toner in a low density part.

Figure 9:
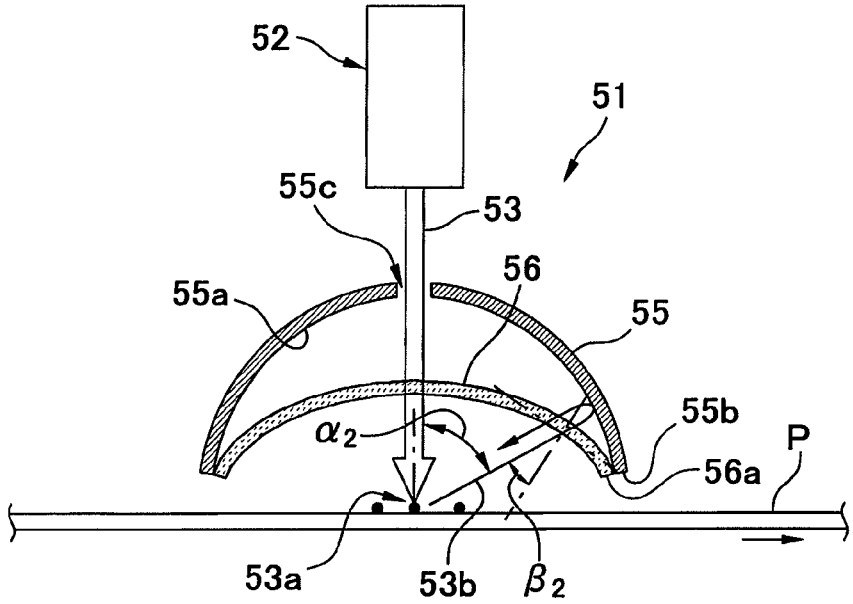
FIG. 9 is a schematic sectional view of a laser fixing apparatus according to a third exemplary embodiment of the present invention.

Next, a laser fixing apparatus according to a third exemplary embodiment of the present invention is described below with reference to FIG. 9.

Similarly to that in the first exemplary embodiment, the principal part of this laser fixing apparatus 51 is constructed from: a laser light generator 52 for projecting laser light 53 onto continuous paper P that is moving; a condenser 55 for causing scattered light 53*b* generated by the laser light 53 reflected by the continuous paper P to be projected again onto the continuous paper P; and a curved surface glass sheet 56 serving as a light transmitting body covering the reflecting surface 55*a* of the condenser 55.

Here, the laser light generator 52 and the condenser 55 are similar to those in the first exemplary embodiment, and hence their description is omitted.

The curved surface glass sheet 56 is formed from a glass sheet having a curved surface convex to the condenser 55 side and an almost uniform thickness in the circumferential direction. Then, the two edges 56*a* of the curved surface glass sheet 56 in the circumferential direction are supported at the edges 55*b* of the condenser 55 in the circumferential direction, so that the curved surface glass sheet 56 covers the reflecting surface 55*a*. Further, laser light 53 emitted from the laser light generator 52 enters through the slit 55*c* formed in the shape of an opening in the condenser 55, and is then transmitted through the curved surface glass sheet 56 and then projected onto the continuous paper P.

As such, the curved surface glass sheet 56 has a curved surface convex to the condenser 55 side. Thus, the light 53*b* scattered at the primary irradiation position 53*a* of the continuous paper P has a small incident angle $\beta_2$ relative to the curved surface glass sheet 56 even in a range where the scattering angle $\alpha_2$ is large. This reduces the reflectivity of the scattered light.

As a result, the loss in the irradiation energy of laser light 53 is reduced in comparison with a case that the flat glass plate 37 is arranged.

Figure 10:
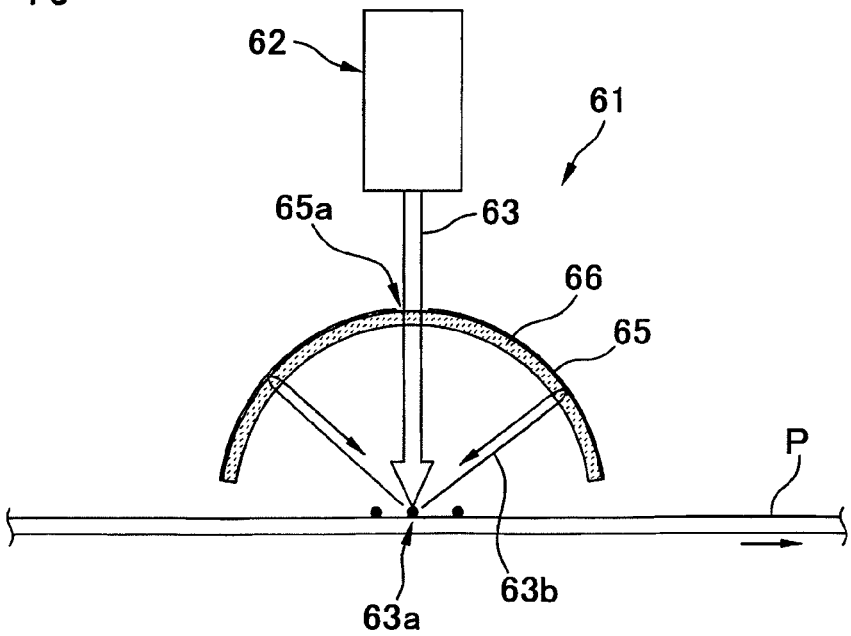
FIG. 10 is a schematic sectional view of a laser fixing apparatus according to a fourth exemplary embodiment of the present invention.

Next, a laser fixing apparatus according to a fourth exemplary embodiment of the present invention is described below with reference to FIG. 10.

Similarly to that in the first exemplary embodiment, the laser fixing apparatus 61 has a laser light generator 62 for projecting laser light 63 onto continuous paper P that is moving. Then, a condenser 65 for causing scattered light 63*b* generated by the laser light 63 reflected by the continuous paper P to be projected again onto the continuous paper P and a glass member 66 for covering this condenser 65 are formed integrally.

Here, the laser light generator 62 is the same as that employed in the first exemplary embodiment.

The glass member 66 is composed of a uniform-thickness member whose surface opposite to the continuous paper P has the shape of a concave cylindrical surface. Further, the glass member 66 is supported such that the position of the center axis of the cylindrical surface is located at the primary irradiation position 63*a* where the laser light 63 is projected onto the continuous paper P.

The condenser 65 is composed of a thin metal film formed in close contact with the outer peripheral surface of the glass member 66, that is, with the surface on the reverse side of the surface opposite to the continuous paper P. Further, the condenser 65 is formed except for the region 65*a* corresponding to the optical path of the laser light 63 projected from the laser light generator 62. Thus, the laser light 63 enters the laser light incidence region 65*a* where the condenser 62 is not provided, and is then transmitted through the glass member 66 and then projected onto the continuous paper P.

The condenser 65 composed of a thin metal film may be fabricated, for example, by vapor deposition of metal such as aluminum. Alternatively, another publicly known fabrication method may be employed.

In the laser fixing apparatus 61 employing the condenser 65 as described above, the laser light 63 is projected onto the primary irradiation position 63*a*. Then, scattered light 63*b* having been reflected is transmitted through the glass member 66, and then reflected by the condenser 65 formed in close contact with the outer peripheral surface. Since the scattered light 63*b* is reflected as such by the outer peripheral surface of the glass member 66 formed in a cylindrical shape, the number of occasions that the scattered light 63*b* passes through an interface between the glass member 66 and air is reduced. Further, the incident angle of the scattered light 63*b* onto the glass member 66 and the reflecting surface can be approximately 0°. This reduces the loss in the irradiation energy of the scattered light 63*b*. Further, since the condenser 65 is fabricated integrally with the glass member 66, fabrication becomes easy.

Next, a laser fixing apparatus according to a fifth exemplary embodiment of the present invention is described below with reference to FIG. 11.

The principal part of this laser fixing apparatus 71 is constructed from: a laser light generator 72 for emitting laser light 73; a condenser 75 for condensing, again onto the continuous paper P, scattered light 73*b* generated by the laser light 73 emitted from the laser light generator 72 and then projected onto and reflected by the continuous paper P at the primary irradiation position 73*a*; and a cylindrical surface glass sheet 76 serving as a light transmitting body covering the reflecting surface of the condenser 75.

Similarly to those in each of the laser fixing apparatuses shown in FIGS. 2, 3, 5, 9, and 10, plural of the laser light generators 72 are arranged in the width direction of the continuous paper P. Thus, laser light is projected over the entire width of the region where an image is formed in the continuous paper P under transport. Then, in the laser fixing apparatus 71, these laser light generators 72 project laser light 73 from an inclined direction relative to the surface of the continuous paper P. That is, the laser light generators 72 are supported at a position inclined rearward in the direction of moving of the continuous paper, and project laser light from this position onto the continuous paper through the slit 75*a* provided in the condenser 75.

Figure 5:
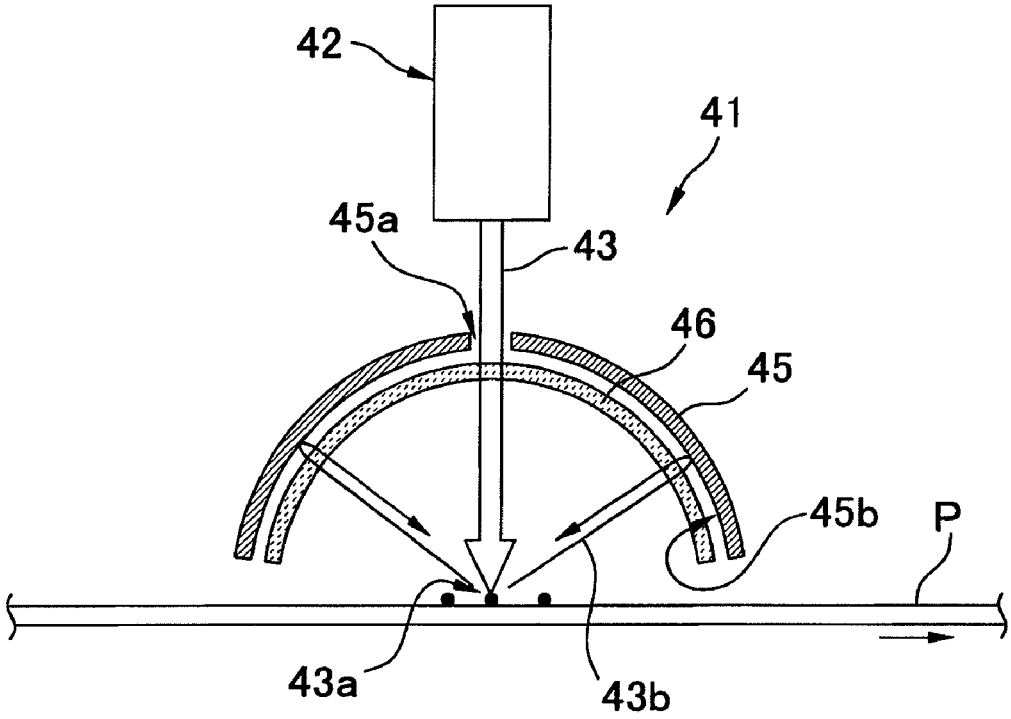
FIG. 5 is a schematic sectional view of a laser fixing apparatus according to a second exemplary embodiment of the present invention.

Similarly to those in the apparatus shown in FIG. 5, the condenser 75 and the cylindrical surface glass sheet 76 are arranged such that the center axis of each cylindrical surface is located at the primary irradiation position 73*a* of the laser light or near the primary irradiation position. Further, in correspondence to the optical path of the laser light emitted from the laser light generator 72, the slit 75*a* provided in the condenser 75 is located rearward relative to the center position in the circumferential direction of the condenser 75.

In the present exemplary embodiment, the laser light generator 72 is supported at a position inclined from a position almost perpendicular to the continuous paper P by approximately 30° rearward in the direction of moving of the continuous paper.

Figure 11:
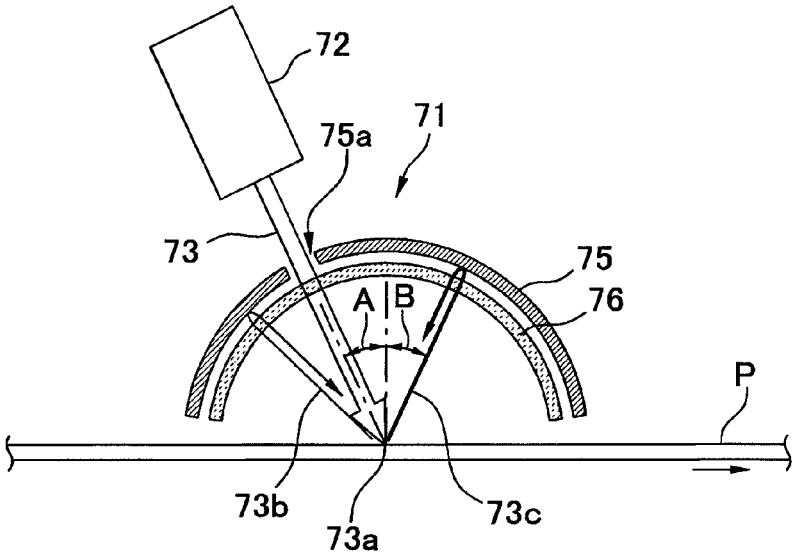
FIG. 11 is a schematic sectional view of a laser fixing apparatus according to a fifth exemplary embodiment of the present invention.

As known in general, the light 73*b* generated when the projected laser light 73 is reflected and scattered at the primary irradiation position 73*a* has an angular distribution shown in FIG. 11. That is, the highest intensity is obtained in the direction of light 73*c* of regular reflection, that is, in the direction where the reflection angle B is equal to the incident angle A. In the present exemplary embodiment, the laser light 73 is projected from a direction inclined relative to the continuous paper P. Thus, the slit 75*a* for introducing the laser light 73 into the condenser 75 is not located in the direction of regular reflection where the reflected light has the highest intensity. Accordingly, in comparison with an apparatus employing a condenser having an opening in the direction of regular reflection, scattered light dissipated to the outside of the condenser 75 is reduced and hence the irradiation energy loss is suppressed.

Here, in the present exemplary embodiment, the cylindrical surface glass sheet 76 has been arranged along with and at a position close to the surface of the condenser 75. Instead, like in the apparatus shown in FIG. 10, a thin metal film may be formed on the outer peripheral surface of the cylindrical surface glass sheet 76 so as to be employed as the condenser. Alternatively, like in the apparatus shown in FIG. 9, a curved surface glass sheet having a curved surface other than a cylindrical surface may be employed as the light transmitting body covering the reflecting surface.

Among the exemplary embodiments described above, in the first exemplary embodiment, the light transmitting body 37*b* has been arranged for covering the rear side condenser 36 and its reflecting surface. Similarly, also in the other exemplary embodiments, a cylindrical surface glass sheet or a curved surface glass sheet may be arranged as a light transmitting body for protecting the rear side condenser and this reflecting surface. By virtue of this, the irradiation energy of the laser light transmitted through the continuous paper can be condensed onto the rear surface of the continuous paper, and this increases the utilization efficiency of the irradiation energy.

Further, in the above-mentioned exemplary embodiments, continuous paper has been employed as a recording medium on which an image is formed. Instead, recording paper sheets having been cut into a size according to a general standard may be employed and transported one by one. A transport belt may be employed as the transport means for the cut recording medium. Then, laser light may be projected onto the recording medium in the course of transport by the transport belt.

In a case that a transport belt is employed as described above, the rear side condenser on the rear side of the recording medium may be not employed. Then, only the light reflected by the recording medium may be condensed at the primary irradiation position by the condenser provided on the irradiation side of the laser light.

On the other hand, in the above-mentioned exemplary embodiments, in a case that the condenser or the rear side condenser absorbs scattered light and is thereby heated up, a cooling device (not shown) for suppressing the heat-up may be provided in the condenser or the rear side condenser.

Figure 12:
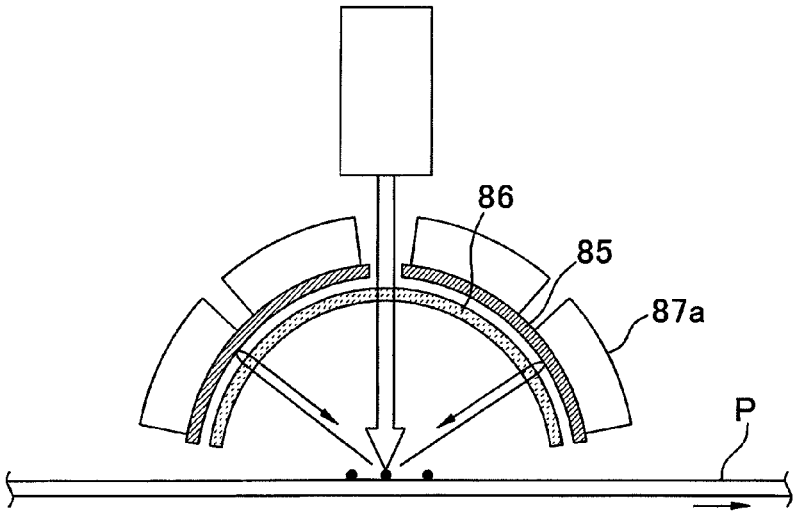
FIG. 12 is a schematic sectional view showing a laser fixing apparatus provided with a cooling device.

For example, the cooling device may be a heat sink 87 provided on the rear surface of the condenser 85 as shown in FIG. 12. Alternatively, a cooling fan (not shown) may be employed for sending an air flow to the rear surface of the condenser. Further, these two may be employed.

The heat sink 87 is provided in close contact with the outer surface of the condenser 85, and may be a thin-blade shaped body fabricated from high-thermal conductivity metal such as copper and aluminum. Plural of the thin-blade shaped bodies are arranged at fixed intervals in the axis direction and the width direction of the condenser 85. The heat sink 87 having such a configuration accelerates heat radiation.

The employed cooling device may be other than the heat sink and the cooling fan described above.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments are chosen and described in order to best explain the principles of the invention and its practical applications, thereby enabling others skilled in the art to understand the invention for various exemplary embodiments and with the various modifications as are suited to the particular use contemplated. It is intended that the scope of the invention be defined by the following claims and their equivalents.

What is claimed is:

1. A laser fixing apparatus comprising:

a laser light generator that generates laser light to be projected onto a recording medium; and a first condenser that reflects and condenses light reflected at an irradiation position of the laser light, such that the reflected light reenters at the irradiation position or near the irradiation position, wherein:

the first condenser has a concave cylindrical surface and is arranged such that a center axis position of the cylindrical surface is located at the irradiation position of the laser light or near the irradiation position, a reflecting surface of the first condenser is covered by a light transmitting body which has a curved convex surface protruded toward a light-condensing surface of the first condenser, and the light reflected at the irradiation position of the laser light reaches to the first condenser through the light transmitting body.

2. The laser fixing apparatus according to claim 1, further comprising:

a second condenser that reflects and condenses light having been projected from the laser light generator and having been transmitted through the recording medium, such that the transmitted light is projected onto a rear surface at the irradiation position or the rear surface near the irradiation position, wherein the second condenser has a concave cylindrical surface and is arranged such that a center axis position of the cylindrical surface is located at the irradiation position of the laser light or near the irradiation position, and a reflecting surface of the second condenser is covered by a light transmitting body.

3. The laser fixing apparatus according to claim 1, wherein the laser light is projected onto the recording medium through an opening in the condenser.

4. The laser fixing apparatus according to claim 2, wherein the light transmitting body has a curved convex surface protruded toward a light-condensing surface of the second condenser.

5. The laser fixing apparatus according to claim 1, wherein the light transmitting body is composed of a sheet material having a cylindrical surface shape whose center axis almost agrees with the center axis of the first condenser and/or the second condenser.

6. The laser fixing apparatus according to claim 1 wherein the first condenser and/or the second condenser is formed in close contact with an outer surface of the light transmitting body.

7. The laser fixing apparatus according to claim 3, wherein the first condenser is formed in close contact with an outer surface of the light transmitting body, and the opening is covered with the light transmitting body.

8. The laser fixing apparatus according to claim 1, wherein the laser light is projected onto the recording medium from a position inclined in a circumferential direction of the first condenser.

9. The laser fixing apparatus according to claim 1, further comprising:

a cooling device that cools the first condenser and/or the second condenser.

10. An image forming apparatus comprising:

an image carrier on which an electrostatic latent image is formed by a difference in electrostatic charging potentials;

a developing unit that transfers image forming material to the electrostatic latent image formed on the image carrier so as to form a visible image;

a transfer unit that transfers the image directly onto a recording medium or alternatively performing primary transfer of the image onto a transfer body and secondary transfer onto a recording medium; and a laser fixing apparatus according to claim 1 that fixes the image forming material of the visible image transferred on the recording medium.

* * * * *